US005117663A

United States Patent [19]

Ida

[11] Patent Number: 5,117,663

[45] Date of Patent: Jun. 2, 1992

[54] KEYLOCKABLE BUCKLE

[75] Inventor: Kazuo Ida, Toyama, Japan

[73] Assignee: Yoshida Kogyo K.K., Tokyo, Japan

[21] Appl. No.: 688,476

[22] Filed: Apr. 22, 1991

[30] Foreign Application Priority Data

Apr. 24, 1990 [JP] Japan ..... 2-43746

[51] Int. Cl.[5] ..... E05B 65/52

[52] U.S. Cl. ..... 70/64; 70/70; 70/71; 292/254

[58] Field of Search ..... 70/13, 75, 69–71, 70/64–67; 24/614, 615, 167, 665, 671, 672; 292/19, 86, 254, DIG. 37

[56] References Cited

U.S. PATENT DOCUMENTS

| | | | |
|---|---|---|---|
| 2,311,298 | 2/1943 | Marsh | 70/70 X |
| 2,720,774 | 10/1955 | Gehrie | 70/71 |
| 3,100,980 | 8/1963 | Humphries | 70/71 |
| 4,864,700 | 9/1989 | Kasai | 24/671 X |
| 4,912,950 | 4/1990 | Crowle | 24/167 X |
| 4,977,650 | 12/1990 | Ida | 24/615 X |

FOREIGN PATENT DOCUMENTS

| | | |
|---|---|---|
| 60-135004 | 7/1985 | Japan . |
| 62-55906 | 4/1987 | Japan . |
| 62-27135 | 7/1987 | Japan . |
| 2133830 | 8/1984 | United Kingdom . |

*Primary Examiner*—Lloyd A. Gall

*Attorney, Agent, or Firm*—Hill, Van Santen, Steadman & Simpson

[57] ABSTRACT

A keylockable buckle comprises a plug having first engaging structure, a socket having second engaging structure engageable with the first engaging structure for releasably coupling the plug and the socket together and a mechanism mounted on the socket for locking the plug and the socket in coupled disposition by the help of a separate key for the purpose of security.

7 Claims, 3 Drawing Sheets

KEYLOCKABLE BUCKLE

BACKGROUND OF THE INVENTION

1. Field of the invention

The present invention relates to a keylockable buckle of the type made of synthetic resin and comprising a plug and a socket adapted to be coupled together, the plug having a cantilevered presser flap on its upper surface which is yieldable downwardly to bring the plug out of coupling engagement with the socket, and particularly relates to a buckle of the type described which can be locked in coupled disposition by a separate key for the purpose of security or burglarproofness.

2. Description of prior art

As commonly known, a buckle of the kind described is very simple in construction and easy to handle because only depression of the presser flap brings a plug out of coupling engagement with a socket. This type of buckle, therefore, is of very wide application, for example, in baggages, knapsackes, and the like. However, for easiness in handling, the conventional buckle has a drawback that it cannot be used on a container, a baggage etc. which are likely to be transported by many and unspecified carriers and are thus liable to robbery.

In these circumstances, there have been proposed recently some buckles for security purpose. A typical buckle of this type has a locking slide plate slidably mounted on a cantilevered presser flap. Sliding the locking slide plate rearwardly on the presser flap causes an abutment provided on the lower surface of the locking slide plate to come into abutting engagement with a rear wall of the buckle, thus bringing the presser flap out of operation so that the plug and socket are locked in coupled disposition.

However, in this convention buckle, by only sliding the locking slide plate forwardly, the presser flap becomes operative so that the buckle is uncoupled and the contents of the baggage is accessible. So, this buckle is unsatisfactory as well.

SUMMARY OF THE INVENTION

With the foregoing difficulties in view, it is therefore an object of the present invention to provide a keylockable buckle which can be locked in coupled disposition by a separate key for security purpose.

According to the present invention, there is provided a keylockable buckle which can be locked in coupled disposition by a separate key; comprising: a plug including a plug proper having first engaging means; a socket adapted to be releasably coupled with the plug, the socket including a socket body including a pair of spaced upper and lower walls, a pair of side walls joining the upper and lower walls on their respective sides and a rear wall provided on the rear end of the socket body to thus define a guide chamber open forward, the lower wall having a cantilevered resilient engaging flap projecting from its inner surface toward the rear wall and including second engaging means engageable with the first engaging means for coupling the plug and the socket together when the plug proper is thrusted into the guide chamber, the upper wall having a cantilevered resilient presser flap overhanging the engaging flap and being yieldable downwardly to depress the engaging flap to bring the second engaging means out of engagement with the first engaging means for uncoupling the plug from the socket, the presser flap having a substantially elliptical recess in its upper surface; a rotor including a cam disk and an eccentric circular axle provided on the upper surface of and eccentrically of the cam disk and having a first key hole therein; and a locking slide plate having a circular blind bore in its lower surface and a second key hole formed through the bottom of the blind bore, the locking slide plate being mounted on the upper surface of the presser flap slidably along the side walls with the eccentric axle rotatably fitted in the blind bore and with the cam disk rotatably received in the recess, so that rotation of the eccentric axle by the separate key inserted through the second key hole into the first key hole causes the locking slide plate to slide reciprocally between a locking position where the locking slide plate comes into abutting engagement with the rear wall to thus lock the plug and the socket in coupled disposition and an uncoupling position where the locking slide plate comes out of abutting engagement with the rear wall.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
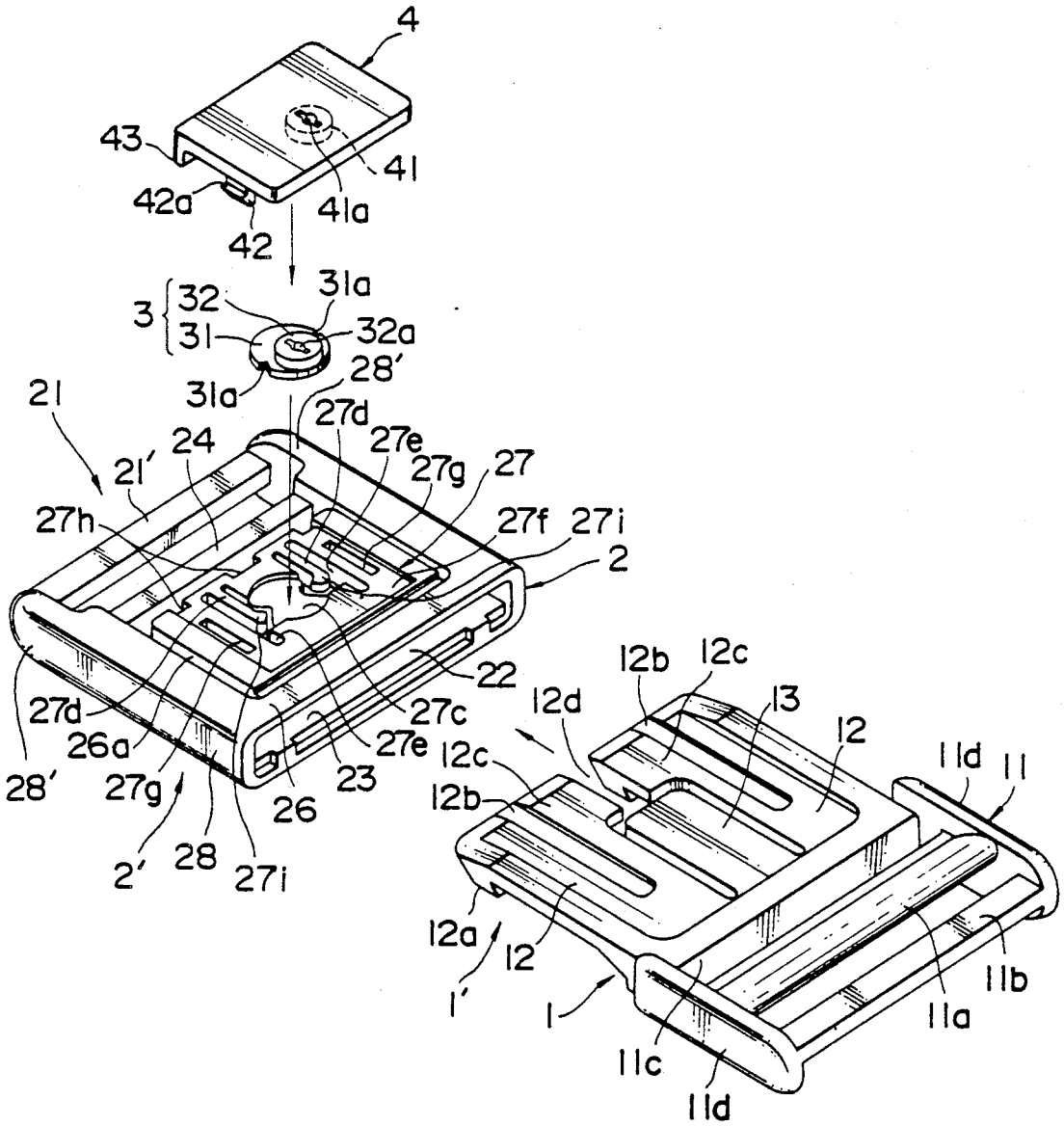
FIG. 1 is an exploded perspective view of a keylockable buckle according to the present invention.
Figure 2:
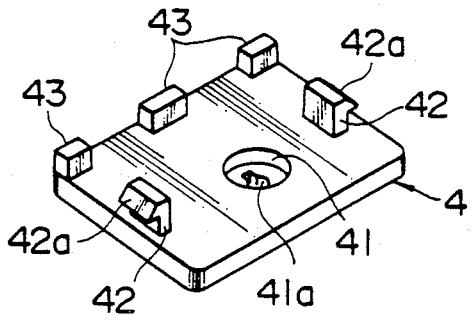
FIG. 2 is a perspective view of a locking slide plate of the buckle of FIG. 1.

As clearly shown in FIG. 1, a keylockable slider according to the present invention is broadly composed of a plug 1 and a socket 2 adapted to be releasably coupled with the plug 1, a rotor 3 rotatably mounted on the upper surface of the socket 2 and a locking slide plate 4 slidably mounted on the upper surface of the socket 2 with the rotor 3 therebeneath. All these parts are molded of synthetic resin.

Figure 3:
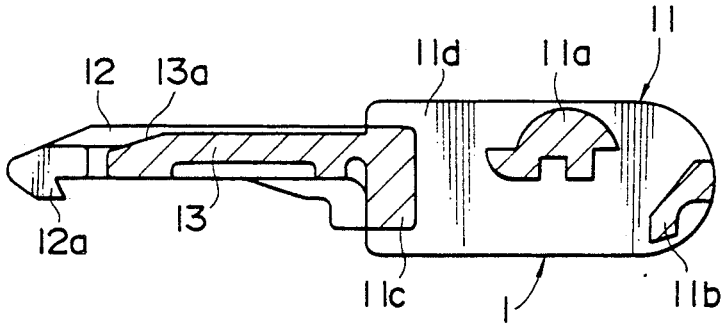
FIG. 3 is a central cross-sectional view of a plug of the buckle of FIG. 1.
Figure 5:
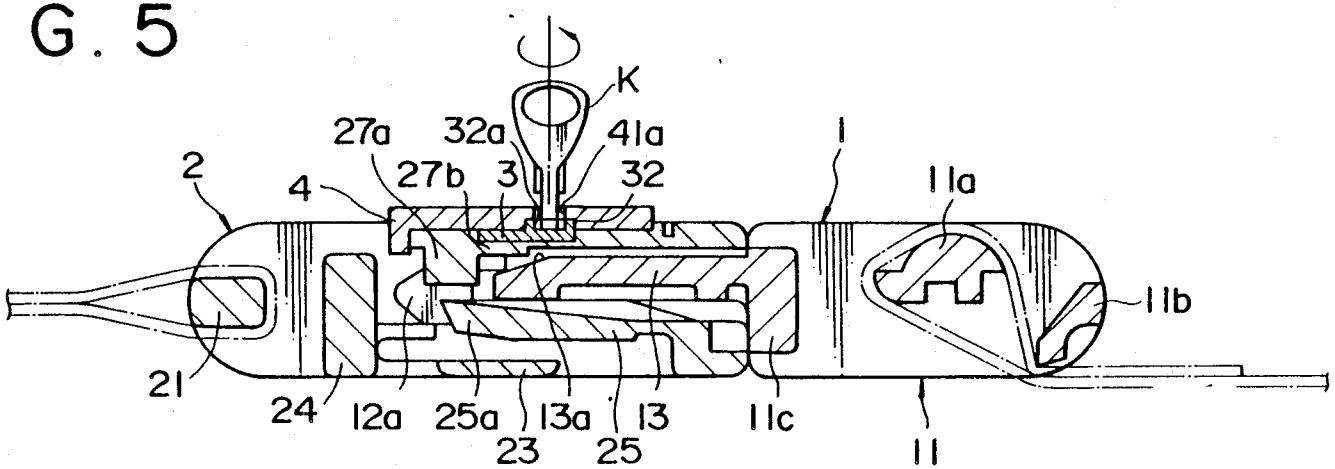
FIG. 5 is a central cross sectional view of the buckle of FIG. 1 in coupled disposition, showing the locking slide plate in unlocked position.
Figure 6:
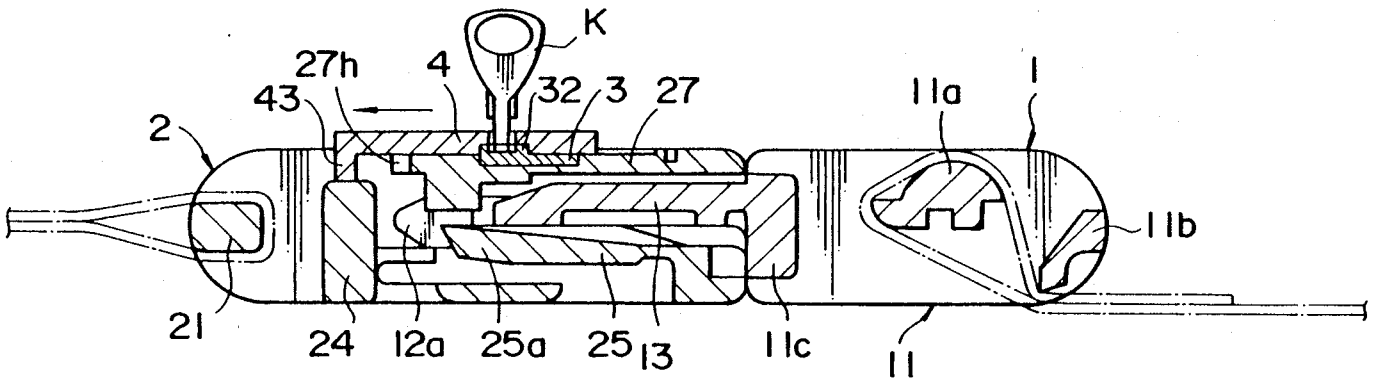
FIG. 6 is a view similar to FIG. 5, but showing the locking slide plate having slid into locked position.

Referring to FIGS. 1 and 3, the plug 1 generally comprises a plug proper 1' adapted for coupling with the socket 2 and a belt-attaching portion 11 integrally formed with the plug proper 1' and adapted to be connected with one end of a belt as shown in phantom lines in FIGS. 5 and 6. As better shown in FIG. 1, the plug proper 1' comprises a base bar **11*c*, a pair of engaging arms 12, 12 formed integrally with and protuberantly extending from the opposite ends of the base bar 11*c* and a resilient tongue 13 formed integrally with the middle of the base bar 11*c* and interposed between the pair of engaging arms 12, 12. The intermediate resilient tongue 13 terminates short of the front ends 12*c*, 12*c* of the engaging arms 12*b*, 12*b*. The engaging arms 12, 12 have their respective front ends 12*c*, 12*c* bent toward but fall short of each other to thus provide a gap 12*d* therebetween. Each of the engaging arms 12, 12 has a engaging hook 12***a* on its lower surface at its front end 12*c*.

The belt attaching portion 11 is in the form of a rectangular frame and includes a pair of opposed side plates 11*d*, 11*d* extending from the opposite ends of the base bar 11*c* in opposite direction to the engaging arms 12, 12, a transverse connecting bar 11*b* interconnecting the side plates 11*d*, 11*d* at their distal ends, and a cross bar 11*a* interconnecting the side plates 11*d*, 11*d* intermediate between the connecting bar 11*b* and the base bar 11*c*, the three bars 11*a*, 11*b* and 11*c* being disposed parallel with one another.

Figure 4:
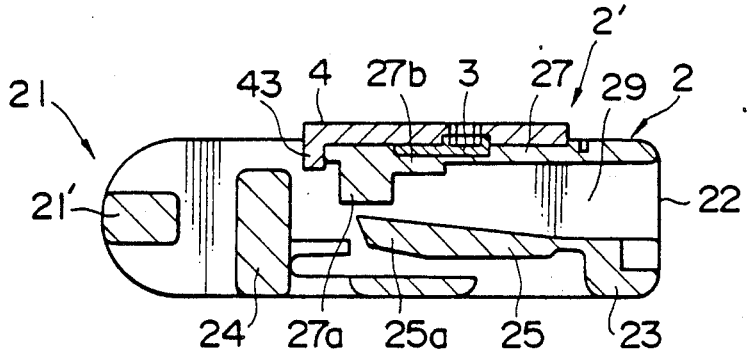
FIG 4 is a central cross-sectional view of a socket of the buckle of FIG. 1.

Referring to FIGS. 1 and 4, the socket 2 generally comprises a socket body 2' and a belt-attaching portion 21 formed integrally therewith and adapted to be connected with the other end of the belt as indicated by phantom lines in FIGS. 5 and 6.

As better shown in FIG. 1, the socket body 2' is a box-like hollow construction and comprises a pair of spaced upper and lower walls 26, 23, and a pair of side walls 28, 28 joining the upper and lower walls 26, 23 on their respective sides, to thereby provide a guide chamber 29 between the upper and lower walls 26, 23. In addition, the socket body 2' includes an upstanding rear wall 24 provided on the rear edge of the lower wall 23 and connecting the side walls 28, 28 together. Each of the side walls 28, 28 extends rearwardly beyond the rear wall 24 to provide a pair of parallel spaced extensions 28', 28'. The socket body 2' has no front wall to thus be open at its front end 22.

As better shown in FIG. 4, a cantilevered resilient engaging flap 25 is mounted on the inner surface of the lower wall 23 adjacent the open end 22 so as to project therefrom rearwardly toward the rear wall 24. The resilient engaging flap 25 has at its front end an engaging tapered end 25*a* for locking engagement with the engaging hooks 12*a*, 12*a* of the engaging arms 12, 12, when the arms 12, 12 of the plug 1 are thrusted through the open end 22 into the guide chamber 29.

The upper wall 26 is slit in U-shape at 26*a* to thus define therein a substantially rectangular, cantilevered resilient presser flap 27 extending rearwardly and disposed in overhanging relation to the cantilevered resilient engaging flap 25. As better shown in FIG. 4, the resilient presser flap 27 has on the lower surface at the middle on the front edge a releasing lug 27*a* for pressure engagement with the tapered end of the resilient engaging flap 25 as described later on. A presser lug 27*b* is provided rearwardly of and contiguously from the releasing lug 27*a* for pressure engagement with the resilient tongue 13 as described hereinbelow. The presser lug 27*b* is considerably less in height than the releasing lug 27*a*.

As shown in FIG. 1, the resilient presser flap 27 has a rectangular shallow recessed surface 27*f* occupying major area of the upper surface thereof and terminating in the distal edge thereof. A plurality of indentations 27*h* are formed at regular intervals along the distal edge of the presser flap 27. The presser flap 27 has a substantially elliptical recess 27*c* substantially centrally in the recessed surface 27*f*. The elliptical recess 27*c* has a short diameter parallel to the side walls 28, 28 and a long diameter perpendicular thereto. A pair of h-shaped slits 27*e*, 27*e* are cut one in each end of the elliptical recess 27*c* and symmetrically relative to each other across the elliptical recess 27*c*, to define therein a pair of parallel spaced resilient fingers 27*d*, 27*d*, one on each side of the elliptical recess 27*c*. The resilient fingers 27*d*, 27*d* extend parallel to the side wall 28 from the distal end toward the proximal end of the presser flap 27 and are disposed symmetrically with each other across the elliptical recess 27*c* so that the fingers 27*d*, 27*d* are resilient perpendicularly to the side wall 28. The resilient fingers 27*d*, 27*d* have at their distal ends respective prongs 27*i*, 27*i* directed toward each other and intruding into the elliptical recess 27*c*. The prongs 27*i*, 27*i* are normally urged under the resiliency of the resilient fingers 27*d*, 27*d* toward each other into contact with the periphery of a cam disk 31 of the rotor 3 for snapping engagement with a pair of notches 31*a*, 31*a* in the periphery of the cam disk 31 of the rotor 3, as closely described later on. The resilient presser flap 27 has also in the recessed surface 27*f* a pair of parallel spaced engaging slots 27*g*, 27*g* disposed outwardly of the resilient fingers 27*d*, 27*d* and extending parallel therewith.

As better shown in FIG. 1, the second belt-attaching portion 21 of the socket 2 is composed of the pair of parallel spaced extensions 28' and 28' and a cross bar 21' connecting the extensions 28', 28' at their distal ends.

Referring to FIG. 1, the rotor 3 includes a substantially circular cam disk 31 and an eccentric circular axle 32 provided on the upper surface of and eccentrically of the cam disk 31. The diameter of the circular cam disk 31 is substantially equal to or slightly less than the short diameter of the elliptical recess 27*c*. The cam disk 31 has a pair of notches 31*a*, 31*a* formed in its peripheral edge in diameterically opposed relation to each other for snapping engagement with the prongs 27*i*, 27*i* of the opposed resilient fingers 27*d*, 27*d*. The eccentric circular axle 32 has a first key hole 32*a* in the upper side at the center thereof.

Referring to FIGS. 1 and 4, the locking slide plate 4 is in the shape of a rectangular flat plate. The locking slide plate 4 has a plurality of abutting blocks 43 mounted on its lower surface at regular intervals along its rear edge for abutting engagement with the rear wall 24 when the slide plate 4 slides into a locking position, as closely described hereinbelow. A pair of opposed engaging legs 42, 42 are mounted one adjacent each side edge of and on the lower surface of the slide plate 4. These engaging legs 42, 42 have at their ends respective hooks 42*i*, 42*a* directed remote from each other. The locking slide plate 4 has a circular blind bore 41 formed in lower surface substantially centrally thereof and a second key hole 41*a* formed through the bottom of the blind hole 41.

For joining the socket 2, the rotor 3 and the locking slide plate 4 described above, the rotor 3 is first placed on the presser flap 27 of the socket 2. Specifically, the cam disk 31 is received in the elliptical recess 27*c* with the notches 31*a*, 31*a* engaged with the prongs 27*i*, 27*i* of the opposed resilient fingers 27*d*, 27*d* and with the eccentric axle 32*a* lying closest to the proximal end of the presser flap 27. Thereafter, the locking slide plate 4 is then placed on the presser flap 27 with the eccentric axle 32 rotatably fit in the blind bore 41. The first key hole 32*a* is disposed in registry with the second key hole 41*a*. In this disposition, the locking slide plate 4 is then depressed against the presser flap 27 to thus bring the hooks 42*a* of the engaging legs 42 into snapping engagement with the engaging slots 27*g*, 27*g* of the presser flap 27. It is to be noted that the length of each slot 27*g* is determined such that the abutment projections 43 come into abutting engagement with the rear wall 24 when the locking slide plate 4 slides rearward along the slots 27*g*, 27*g* while the abutment projections 43 come into fitting engagement with the indentations 27*h* when the locking slide plate 4 slides forward. As a result, the locking slide plate 4 is slidably mounted on the presser flap 27 with the eccentric axle 32 rotatably fit in the blind bore 41 and the cam disk 31 rotatably received in the recess 27*c*. Now that the eccentric axle 32 lies closest to the proximal end of the presser flap 27, the locking slide plate 4 assumes unlocking position as better shown in FIG. 5. As shown in FIG. 1, the engaging arms 12, 12 of the plug 1 have on their upper surface respective grooves 12*b*, 12*b* extending longitudinally thereof. These grooves 12*b*, 12*b* are intended to prevent the hooks 42*a*, 42*a* of the engaging legs 42, 42 from interfering against the engaging arms 12, 12 thrusted into the guide chamber 29.

In order to couple the plug 1 and the socket 2 together, the pair of engaging arms 12, 12 are thrusted through the open end 22 into the guide chamber 29 of the socket 2. The engaging arms 12, 12 slide forward on the upper surface of the resilient engaging flap 25 against the resiliency of the flap 25 until the engaging hooks 12*a*, 12*a* of the engaging arms 12, 12 advance beyond the engaging tapered end 25*a* of the engaging flap 25, whereupon the engaging flap 25 springs back under its own resiliency, to bring its tapered end 25*a* into locking engagement with the engaging hook 12*a* of the engaging arms 12, as shown in FIG. 5.

In order to uncouple the plug 1 from the socket 2, merely depressing the locking slide plate 4 and hence the presser flap 27 toward the engaging flap 25 causes the releasing lug 27 to pass through the gap 12*d* between the opposed front ends 12*c*, 12*c* of the engaging arms 12, 12 and depress the engaging tapered end 25*a* of the resilient engaging flap 25, thus bringing the locking tapered end 25*a* of the engaging flap 25 out of locking engagement with the engaging hooks 12*a*, 12*a* of the engaging arms 12, 12. As the presser flap 27 is depressed, similarly, the presser lug 27*b* depresses the resilient tongue 13 of the plug 1 against the resiliency thereof. Consequently, the instant the tapered end 25*a* of the engaging flap 25 comes out of locking engagement with the engaging hooks 12*a*, 12*a* of the engaging arms 12, 12, the plug 1 snaps out of the socket 2 under resiliency of the resilient tongue 13.

For locking the plug 1 and socket 2 in coupled disposition, a separate key K is first inserted through the second key hole 41*a* of the locking slide plate 4 which now assumes unlocking position (FIG. 5) into the first key hole 32*a* of the rotor 3. Then, the eccentric axle 32 of the rotor 3 is rotated by the separate key K, whether clockwise or anticlockwise, at the angle of 180 degrees, as indicated by an arrow in FIG. 5. As the eccentric axle 32 of the rotor 3 is thus rotated, the cam disk 31 is also rotated while being confined within the short diameter of the elliptical recess 27*c*. Consequently, by the camming action of the cam disk 31, the locking slide plate 4 slides in the direction indicated by an arrow in FIG. 6 to assume a locking position (FIG. 6) where the abutting projections 43 of the slide plate 4 come into abutting engagement with the upper surface of the rear wall 24 to thus lock the plug 1 and the socket 2 in coupled disposition. At this instant, the prongs 27*i*, 27*i* of the opposed resilient fingers 27*d*, 27*d* come into snapping engagement with the notches 31*a*, 31*a* in the cam disk 31 so that the locking slide plate 4 is retained in the locking position.

For unlocking the plug 1 from the socket 2, the separate key K is again inserted through the second key hole 41*a* into the first key hole 32*a*. Then, the eccentric axle 32 is rotated at the angle of 180 degrees. Likewise, by the camming action of the cam disk 31, the locking slide plate 4 slides back into unlocking position (FIG. 5) where the abutting projections 43 of the locking slide plate 4 comes into fitting engagement with the indentations 27*h* of the presser flap 27. At this instant, the prongs 27*i*, 27*i* of the opposed resilient fingers 27*d*, 27*d* comes into snapping engagement with the notches 31*a*, 31*a* in the cam disk 31 so that the locking slide plate 4 is retained in the unlocking position. Once the abutting projections 43 come out of abutting engagement with the rear wall 24, the presser flap 27 becomes operative for uncoupling of the plug 1 from the socket 2.

With the construction of the present invention, only a holder of a separate key K can unlock the buckle with the separate key K, so that this keylockable buckle is superior in security or burglarproofness and can be widely used on a container, a baggage etc. which are likely to be transported by many and unspecified carriers.

Obviously, various modifications and variations of the present invention are possible in the light of the above teaching. It is therefore to be understood that within the scope of the appended claims the invention may be practiced otherwise than as specifically described.

What is claimed is:

1. A keylockable buckle which can be locked in coupled disposition by a separate key comprising:

(a) a plug including a plug proper having first engaging means;

(b) a socket adapted to be releasably coupled with the plug, the socket including a socket body including a pair of spaced upper and lower walls, a pair of side walls joining the upper and lower walls on their respective sides and a rear wall provided on the rear end of the socket body to thus define a guide chamber open forward, the lower wall having a cantilevered resilient engaging flap projecting from its inner surface toward the rear wall and including second engaging means engageable with the first engaging means for coupling the plug and the socket together when the plug proper is thrusted into the guide chamber, the upper wall having a cantilevered resilient presser flap overhanging the engaging flap and being yieldable downwardly to depress the engaging flap to bring the second engaging means out of engagement with the first engaging means for uncoupling the plug from the socket, the presser flap having a substantially elliptical recess in its upper surface;

(c) a rotor including a cam disk and an eccentric circular axle provided on the upper surface of and eccentrically of the cam disk and having a first key hole therein; and (d) a locking slide plate having a circular blind bore in its lower surface and a second key hole formed through the bottom of the blind bore, the locking slide plate being mounted on the upper surface of the presser flap slidably adjacent the side walls with the eccentric axle rotatably fitted in the blind bore and with the cam disk rotatably received in the recess, so that rotation of the eccentric axle by the separate key inserted through the second key hole into the first key hole causes the locking slide plate to slide reciprocally between a locking position where the locking slide plate comes into abutting engagement with the rear wall to thus lock the plug and the socket in coupled disposition and an uncoupling position where the locking slide plate comes out of abutting engagement with the rear wall.

2. A keylockable buckle according to claim 1, the plug proper comprising a base bar and a pair of engaging arms formed integrally with and protruding perpendicularly from the base bar, the first engaging means comprising engaging hooks provided on its lower surfaces at the front ends of the engaging arms, the second engaging means comprising an engaging tapered end provided at the front end of the resilient engaging flap.

3. A keylockable buckle according to claim 2, the presser flap having on the lower surface at the middle on the front edge a releasing lug which, when the presser flap is depressed, passes through a gap between the opposed front ends of the engaging arms and comes into depressing engagement with the engaging tapered end of the resilient engaging flap.

4. A keylockable buckle according to claim 3, the plug proper further including a resilient tongue formed integrally with the base bar and extending between and parallel with the pair of engaging arms but terminating short of the front ends of the engaging arms; the presser flap further having rearwardly of and contiguously to the releasing lug a presser lug which is less in height than the releasing lug and which, when the presser flap is depressed, depresses the resilient tongue against its resiliency so that the plug snaps out of the socket under resiliency of the resilient tongue the moment the engaging tapered end of the engaging flap comes out of engagement with the engaging hooks of the engaging arms.

5. A keylockable buckle according to claim 1, the presser flap having on its upper surface a pair of opposed resilient fingers one on each side of the elliptical recess which resilient fingers extend parallel to the side walls from the distal end toward the proximal end of the presser flap and are disposed symmetrically with each other across the recess so that the fingers are resilient substantially perpendicularly to the side walls, the resilient fingers having at their distal ends respective prongs directed toward each other and intruding into the elliptical recess; the cam disk having a pair of notches formed in its peripheral edge in diametrically opposed relation to each other and adapted for snapping engagement with the prongs when the locking slide plate assumes either the locking position or the uncoupling position.

6. A keylockable buckle according to claim 5, the presser flap further including a pair of parallel spaced engaging slots disposed outwardly of the respective resilient fingers and extending parallel therewith; the locking slide plate being in the form of a rectangular flat plate and further having a pair of engaging legs one adjacent each side edge of and on the lower surface of the slide plate, which engaging legs have at their ends respective hooks directed remote from each other, the hooks of the engaging legs coming into snapping engagement with the slots in the presser flap so that the locking slide plate is slidably mounted on the presser flap.

7. A keylockable buckle according to claim 1, the locking plate having on its lower surface at its front edge an abutting projection; the presser flap having an indentation in a distal edge: the abutting projection being adapted to come into abutting engagement with the rear wall when the locking slide plate assumes the locking position and to come into interfitting engagement with the indentation when the locking slide plate assumes the uncoupling position.

* * * * *